United States Patent [19]

Okamoto et al.

[11] Patent Number: 5,006,079

[45] Date of Patent: Apr. 9, 1991

[54] CONNECTOR WITH BUILT-IN THROUGH CAPACITORS

[75] Inventors: Hiroyuki Okamoto; Kunio Hoshino, both of Shizuoka, Japan

[73] Assignee: Yazaki Corporation, Japan

[21] Appl. No.: 443,330

[22] Filed: Nov. 30, 1989

[30] Foreign Application Priority Data

Dec. 8, 1988 [JP] Japan ..... 63-310749

[51] Int. Cl.[5] ..... H01R 13/648; H01R 13/66

[52] U.S. Cl. ..... 439/607; 439/620; 439/906

[58] Field of Search ..... 439/607-610, 439/620, 906, 904, 32, 33

[56] References Cited

U.S. PATENT DOCUMENTS 3,005,174 10/1961 Pifer ..... 439/607

4,653,836 3/1987 Peele ..... 439/610

*Primary Examiner*—Gary F. Paumen

*Attorney, Agent, or Firm*—Wigman & Cohen

[57] ABSTRACT

To reduce thermal stress produced at soldering process of a connector with built-in through capacitors having a resin connector housing, connector pins passed through the resin connector housing, a metallic shield casing for covering the resin connector housing, and through capacitors formed between the connector pins and the metallic shield casing, respectively, the metallic shield casing is formed in particular with roughly U-shaped cross section deformable projections or divided into at least two parts having a slidably overlapped joint end portion, respectively.

2 Claims, 6 Drawing Sheets

CONNECTOR WITH BUILT-IN THROUGH CAPACITORS

BACKGROUND OF THE INVENTION

1. Field of the Invention

The present invention relates to a connector provided with built-in through capacitors for eliminating noise, and more specifically to a connector provided with built-in through capacitors resistant against thermal stress caused by soldering, for instance.

2. Description of the Prior Art

An example of prior-art connectors with built-in through capacitors is disclosed in Japanese Published Unexamined (Kokai) Utility Model Application No. 59-27022, as shown in FIGS. 1 to 4. The prior-art connector comprises a connector housing 100 made of a synthetic resin and formed with an inner partition 110, a shield casing 300 made of a metal and used as shielding plates and a grounding plate, a plurality of through capacitors 400 fitted to through holes 310 formed in the shield casing 300, and a plurality of connector pins 200 each passing through the partition 110 and the through capacitor 400, as depicted in FIGS. 1 and 2. The through capacitor 400 is composed of an outer cylindrical electrode 410 fixed to the shield casing 300 by solder 500, an inner cylindrical electrode 420 fixed to the connector pin 200 by solder 510, and a dielectric material 430 disposed between the outer and inner cylindrical electrodes 410 and 420. These through capacitors 400 serve to ground noise superimposed upon signals transmitted through the connector pins 200, that is, to minimize noise from being passed through the connector.

In the prior-art connector with build-in capacitors, however, since the connector housing 100 (i.e. the inner partition 110) for supporting the connector pins 200 is made of a synthetic resin, but the shield casing 300 for shielding the connector housing 100 and the connector pins 200 is made of a metal, the thermal expansion coefficient of the resin housing 100 is larger than that of the metallic shield casing 300. Therefore, there exists no problem at the normal temperature, because no thermal stress is generated in the connector; that is, the central axis $CL_1$ of the housing inner partition 110 matches that $CL_2$ of the through capacitor 400 as shown in FIG. 4(A). At higher temperature, in particular at soldering process for instance, however, since a thermal stress is generated in the connector; that is, the central axis $CL_1$ of the housing partition 110 is offset or dislocated away from that $CL_2$ of the through capacitor 400 due to a difference in thermal expansion coefficient between the resin and metal as shown in FIG. 4(B), there exists a problem in that a thermal stress is inevitably generated in the solder 500 or 510 and the through capacitors 400 so that cracks are easily produced thereat at soldering process.

To overcome the above-mentioned problem, although it is possible to determine difference in the thermal expansion coefficient between the resin housing and the metallic shield casing as small as possible under due consideration of the molding material and molding process, these countermeasures are difficult to obtain a satisfactorily practical effect.

SUMMARY OF THE INVENTION

With these problems in mind, therefore, it is the primary object of the present invention to provide a connector with built-in through capacitors resistant against thermal stress without producing cracks in the capacitors and the solder portions, without being subjected to the influence of the molded resin material and molding method.

To achieve the above-mentioned object, the connector with built-in through capacitors according to the present invention comprises: (a) an insulated connector housing (10); (b) at least two connector pins (20) passing through and supported by said insulated connector housing; (c) a conductive shield casing (30) for covering said insulated connector housing; (d) at least two through capacitors (40) formed between said connector pin and said conductive shield casing, respectively; and (e) means (32, 33) for reducing thermal stress due to difference in thermal expansion coefficient between said insulated connector housing and said conductive shield casing, said thermal stress reducing means being formed in any one of said insulated connector housing and said conductive shield casing, which is made of a material with a smaller thermal expansion coefficient. When the insulated connector housing is made of a synthetic resin and the conductive shield casing is made of a metal, the thermal stress reducing means is a roughly U-shaped cross section projection (32) formed in the metallic shield casing or a metallic shield casing divided into at least two parts (30A, 30B) slidably overlapped at a joint end portion (30A1, 30B1) thereof, respectively.

In the connector according to the present invention, since thermal stress reducing means is formed in the metallic shield casing with a small thermal expansion coefficient, even when the resin connector housing with a large thermal expansion coefficient is deformed relative to the metallic shield casing by temperature difference (e.g. at soldering process), it is possible to effectively reduce the thermal stress generated between the metallic shield casing and the resin connector housing due to expansion or compression of the resin connector housing, that is, it is possible to effectively reduce cracks generated at the solder portions of the through capacitors, thus improving the reliability of the capacitors or the connectors with built-in through capacitors.

BRIEF DESCRIPTION OF THE DRAWINGS

The features and advantages of the connector according to the present invention will be more clearly appreciated from the following description taken in conjunction with the accompanying drawings in which.

DETAILED DESCRIPTION OF THE PREFERRED EMBODIMENTS

A first embodiment of the connector according to the present invention will be described hereinbelow with reference to the attached drawings. The feature of this first embodiment is to provide a metallic shield casing formed with U-shaped cross-section deformable projections for absorbing a relative deformation caused by thermal stress generated between the resin connector housing and the metallic shield casing, because the thermal expansion coefficient of resin is larger than that of metal.

Figure 1:
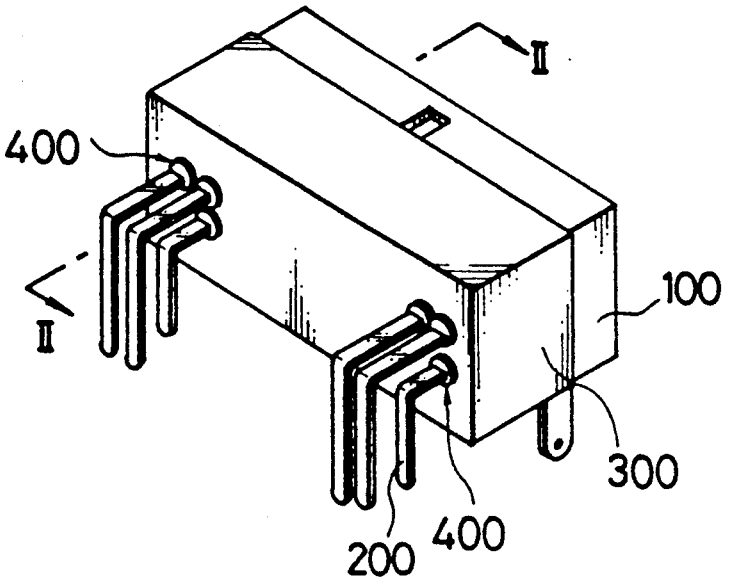
FIG. 1 PRIOR ART
FIG. 1 is a perspective view showing a prior-art connector with built-in through capacitors.
Figure 2:
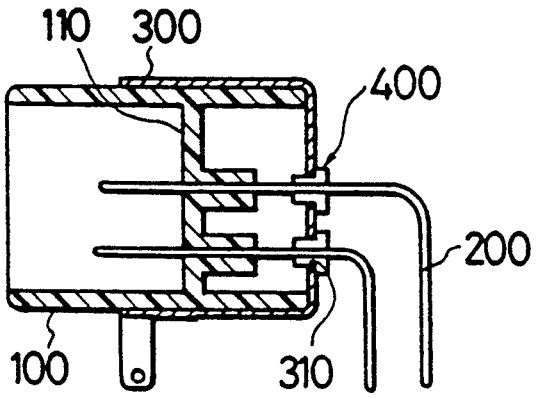
FIG. 2 PRIOR ART
FIG. 2 is a cross-sectional view taken along the line II—II in FIG. 1.
Figure 3:
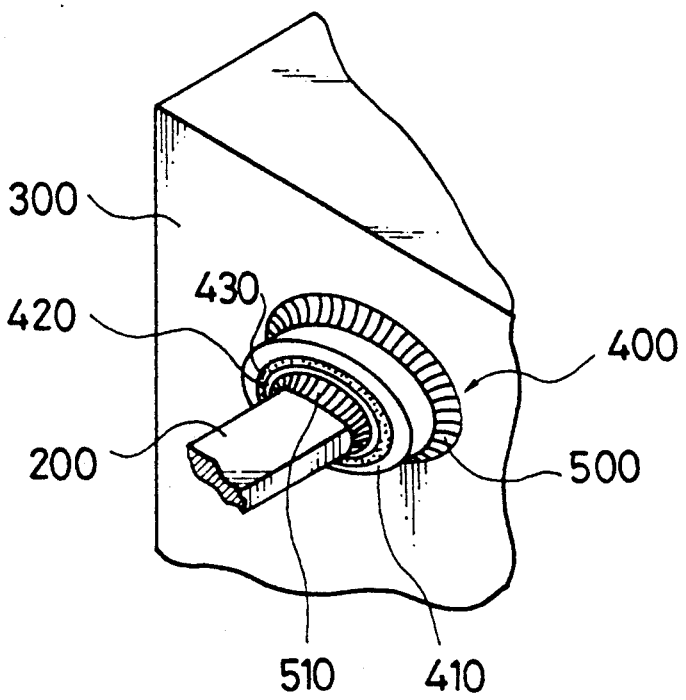
FIG. 3 PRIOR ART
FIG. 3 is an enlarged perspective view showing a through capacitor.
Figure 4A:
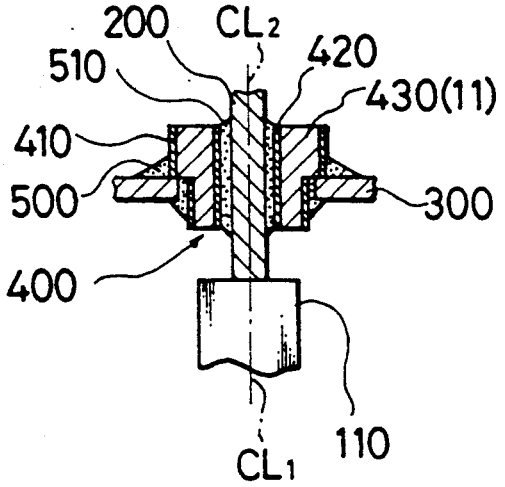
FIG. 4(A) PRIOR ART
FIG. 4(A) is an enlarged cross-sectional view showing the through capacitor at the normal temperature.
Figure 4B:
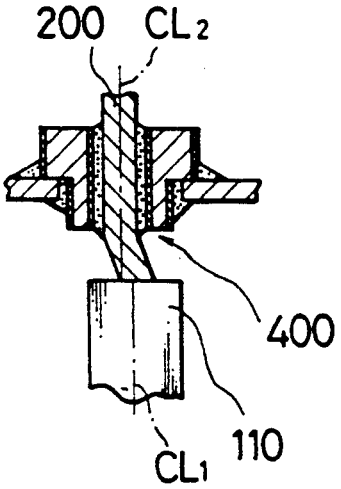
FIG. 4(B) PRIOR ART
FIG. 4(B) is an enlarged cross-sectional view showing the through capacitor at a higher temperature.
Figure 5:
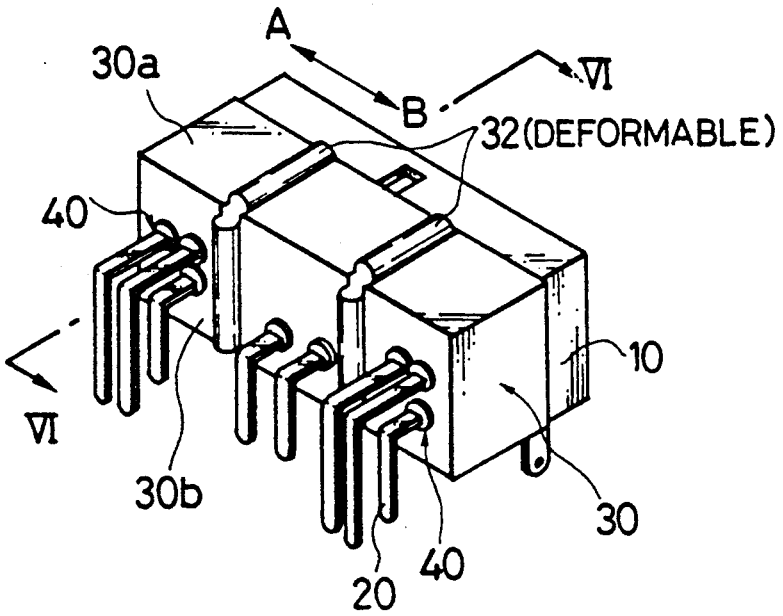
FIG. 5 is a perspective view showing a first embodiment of the connector with built-in capacitors according to the present invention.
Figure 6:
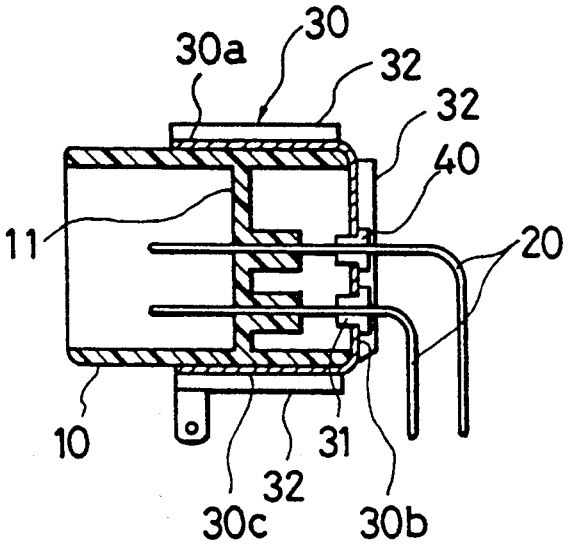
FIG. 6 is a cross-sectional view taken along the line VI—VI in FIG. 5.

With reference to FIGS. 5, 6 and 7, the connector comprises a connector housing 10 made of a synthetic resin and formed with an inner partition 11, a shield casing 30 made of a metal and used as a shielding plate and a grounding plate, a plurality of through capacitors 40 fitted to through holes 31 formed in the shield casing 30, and a plurality of connector pins 20 each passed through the partition 11 and the through capacitor 40. The through capacitor 40 is composed of an outer cylindrical electrode 41 fixed to a back surface **30*b* of the shield casing 30 by solder 50, an inner cylindrical electrode 42 fixed to the connector pin 20 by solder 51, and a dielectric material 43 disposed between the outer and inner cylindrical electrodes 41 and 42. In the same way, the through capacitors 40 serve to ground noise superimposed upon signals transmitted through the connector pins 20**, that is, to minimize noise from being passed through the connector.

Figure 7A:
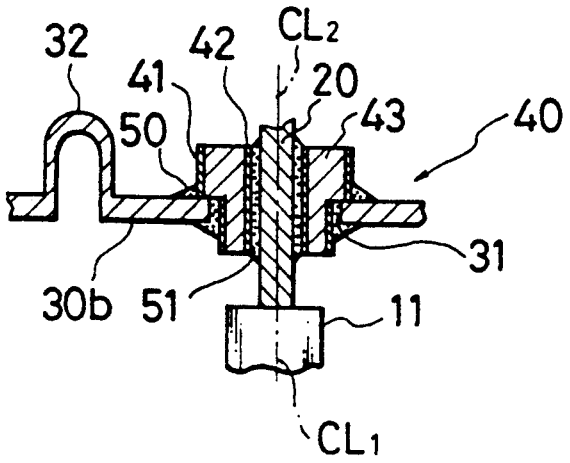
FIG. 7(A) is an enlarged cross-sectional view showing a through capacitor at the normal temperature.
Figure 7B:
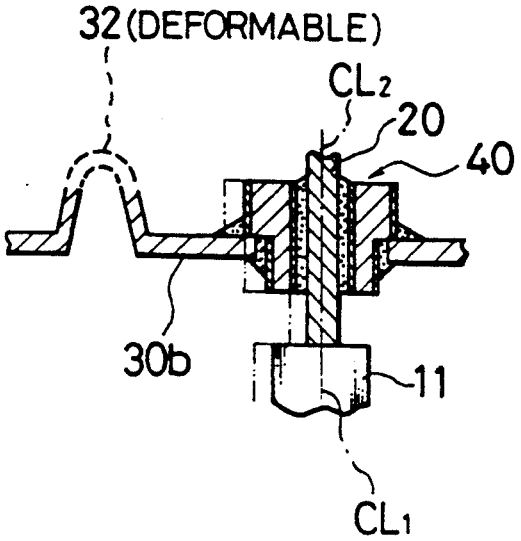
FIG. 7(B) is an enlarged cross-sectional view showing a through capacitor at a higher temperature.

Being different from the prior-art connector, in this first embodiment, plural U-shaped cross section deformable projections 32 are formed, being arranged at regular intervals along the longitudinal direction (A-B direction in FIG. 5) thereof, in the upper surface **30*a*, the back surface 30*b* and the lower surface 30*c* of the metallic shield casing 30. Since these deformable projections 32 formed by a pressing machine can be easily deformed in the longitudinal direction of the metallic shield casing 30, it is possible to effectively absorb thermal tensile or compressive stress caused by material deformation due to difference in thermal expansion coefficient between the resin connector housing 10 or the resin inner partition 11 and the metallic shield casing 30. Therefore, even if the resin housing 10 with a large thermal expansion coefficient is deformed more largely than the metallic shield casing 30 with a small thermal expansion coefficient, these deformable projections 32 can effectively absorb the thermal stress or the deformation difference between the two. In other words, the mutual positional relationship between the central axis $CL_1$ of the housing inner partition 11 and that $CL_2$ of the through capacitor 40 can be maintained at both the normal and higher temperature, as shown in FIGS. 7(A) and 7(B), because the inner partition 11 and the through capacitor 40 are simultaneously dislocated at a higher temperature to the position as shown by dashed lines in FIG. 7(B), for instance, due to the presence of the deformable projection 32. As a result, it is possible to prevent cracks from being generated at the solder portions 50 and 51 of the through capacitor 40 or to prevent the through capacitor 40 from an abnormal thermal stress, in particular during the soldering process. In this first embodiment, it is of course possible to form roughly U-shaped deformable grooves instead of the deformable projections 32. In this case, the connector housing 10** is formed with a plurality of grooves for accommodating these deformable grooves.

Figure 8:
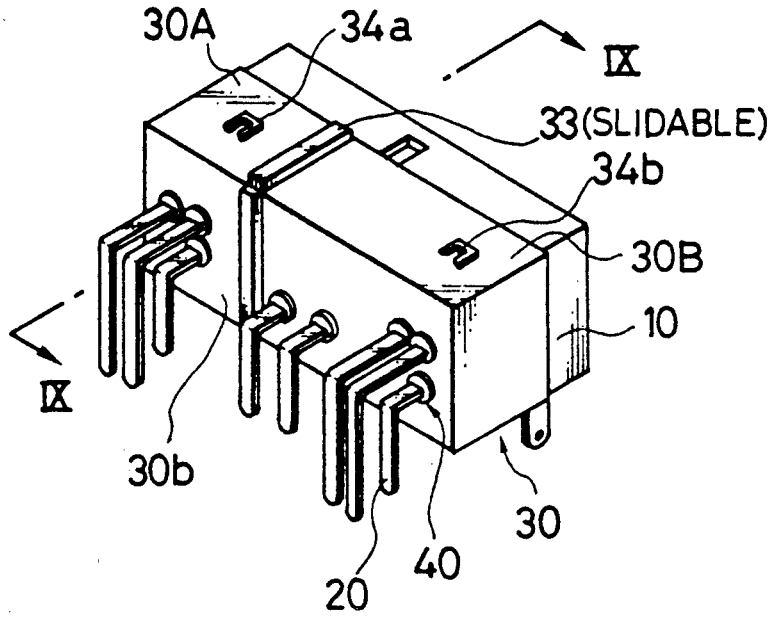
FIG. 8 is a perspective view showing a second embodiment of the connector with built-in capacitors according to the present invention.
Figure 9:
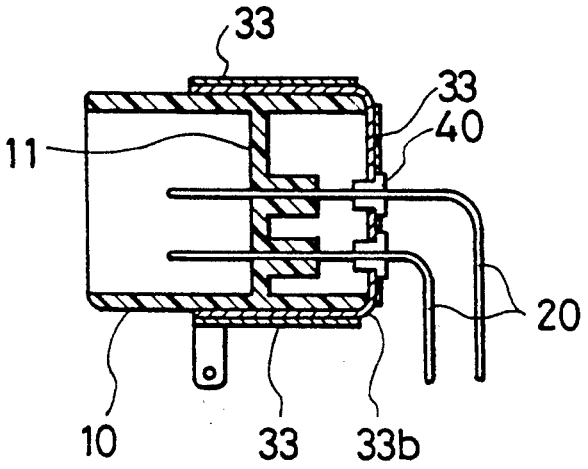
FIG. 9 is a cross-sectional view taken along the line IX—IX in FIG. 8.
Figure 10:
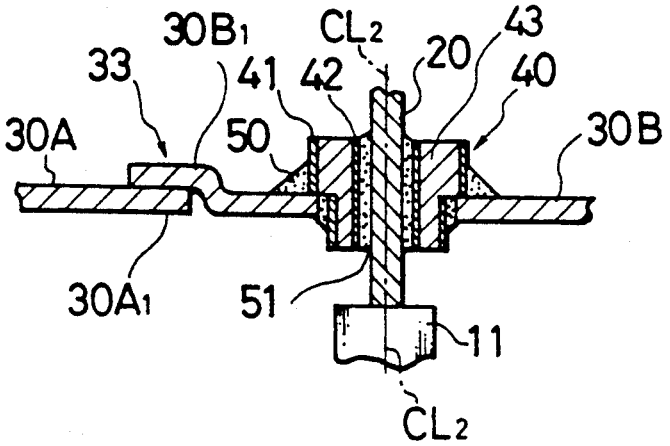
FIG. 10(A) is an enlarged cross-sectional view showing a through capacitor at the normal temperature.
FIG. 10(B) is an enlarged cross-sectional view showing a through capacitor at a higher temperature.

A second embodiment of the connector according to the present invention will be described hereinbelow with reference to FIGS. 8 to 10. The feature of this second embodiment is to divide the metallic shield casing 30 into two parts 30A and 30B slidably overlapped at a joint end portion thereof, respectively to absorb a relative deformation caused by thermal stress generated between the resin connector housing 10 and the metallic shield casing 30. As shown in FIGS. 8 and 9, the metallic shield casing 30 is divided into a first shield casing 30A and a second shield casing 30B and further slidably overlapped with each other by joint end plates 30A1 and 30B1 thereof, respectively at an appropriate position 33. Each divided shield casing 30A or 30B is engaged with the connector housing 10 with locking tab **34*a* or 34*b***, or another appropriate fixing member.

Figure 10B:
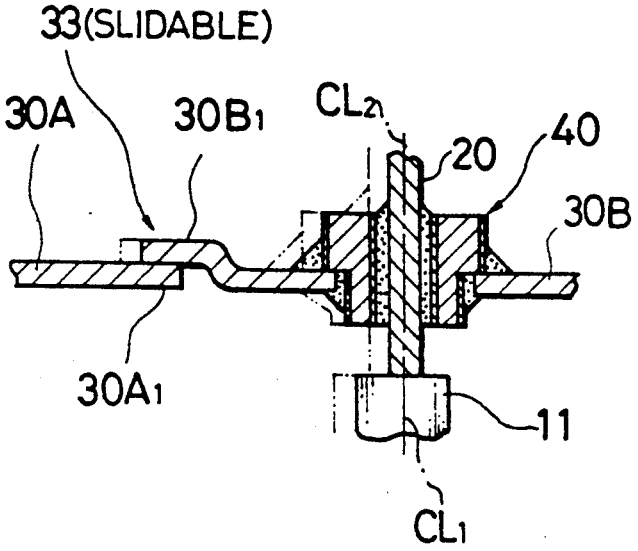

As depicted in FIGS. 10(A) and 10(B), a joint end plate 30B1 of the second casing 30B is bent a little outwardly and slidably overlapped with a joint end plate 30A1 of the first casing 30A so that the two end plates 30A1 and 30B1 can be slid relative to each other without having a gap between the two joint end plates 30A1 and 30B1.

The structural features and functional effects of this second embodiment other than those described above are substantially the same as with the first embodiment previously described and any detailed description of them is believed to be unnecessary.

In this second embodiment, it is also possible to absorb thermal tensile or compressive stress caused by material deformation due to difference in thermal expansion coefficient between the resin connector housing 10 or the resin inner partition 11 and the metallic shield casing 30. Therefore, even if the resin housing 10 with a large thermal expansion coefficient is deformed largely than the metallic shield casing 30 with a small thermal expansion Boefficient, these slidably overlapped joint end plates 30A1 and 30B1 can effectively absorb the thermal stress or the deformation difference between the two. In other words, the mutual positional relationship between the central axis $CL_1$ of the housing inner partition 11 and that $CL_2$ of the through capacitor 40 can be maintained at both the normal and higher temperature, as shown in FIGS. 10(A) and 10(B), because the inner partition 11 and the through capacitor 40 are simultaneously dislocated at a higher temperature to a position as shown by dashed lines in FIG. 10(B), for instance. As a result, it is possible to prevent cracks from being generated at the solder portions 50 and 51 of the through capacitor 40 or to prevent the through capacitor 40 from an abnormal thermal stress. In this second embodiment, it is of course possible to divide the shield casing 30 into three or more parts slidably overlapped with each other by a joint end portion thereof, respectively to absorb a relative deformation between the resin connector housing 10 and the metallic shield casing 30.

Further, since the two divided shield casings 30A and 30B are slidably overlapped with each other so as to be in contact with each other over a sufficiently long distance without gap between the two, it is possible to maintain a sufficient shielding effect.

In the above first and second embodiments, the connector housing is made of a synthetic resin. However, when the connector housing is made of a ceramic for instance, since the thermal expansion coefficient of the ceramic housing is smaller than that of the metallic shield casings, the deformable or slidably overlapped portion is formed in the ceramic connector housing to effectively absorb the thermal stress caused by material deformation due to difference in thermal expansion coefficient between the two.

As described above, in the connector with built-in through capacitors, according to the present invention including an insulated connector housing and a conductive shield casing, since the thermal stress reducing means are provided for any one of the connector housing and the shield casing, which is made of a material with a smaller thermal expansion coefficient, in order to absorb thermal stress caused by deformation of the material having a larger thermal expansion coefficient, it is possible to effectively reduce thermal stress caused by temperature difference (in particular at soldering process) and applied to the through capacitors and the solder portions of the capacitors, and therefore to prevent cracks from being produced at the solder portions, thus improving the reliability of the through capacitors of the connector and the connector with built-in through capacitors.

What is claimed is:

1. A connector provided with built-in through capacitors, comprising:

(a) an insulated connector housing;

(b) at least two connector pins passing through and supported by said insulated connector housing;

(c) a conductive shield casing for covering said insulated connector housing;

(d) at least two through capacitors formed between said connector pins and said conductive shield casing, respectively; and (e) means for reducing thermal stress due to difference in thermal expansion coefficient between said insulated connector housing and said conductive shield casing, said thermal stress reducing means being formed in any one of said insulated connector housing and said conductive shield casing, and being made of a material with a smaller thermal expansion coefficient, wherein said insulated connector housing is made of a synthetic resin; said conductive shield casing is made of a metal; and said thermal stress reducing means is said metallic shield being divided into at least two parts slidably overlapped at a joint end portion thereof, respectively.

2. A connector provided with built-in through capacitors, comprising:

(a) an insulated resin connector housing;

(b) at least two connector pins passing through and supported by said insulated resin connector housing;

(c) a conductive metal shield casing for covering said insulated connector housing, said conductive metal shield being divided into at least two parts slidably overlapped at a joint end portion thereof, respectively, to reduce thermal stress due to a difference in thermal expansion coefficients of said insulated resin connector housing and said conductive metal shield; and (d) at least two through capacitors formed between said connector pins and said conductive metal shield casing, respectively.

* * * * *